US007021305B2

(12) United States Patent
Lee

(10) Patent No.: US 7,021,305 B2
(45) **Date of Patent: *Apr. 4, 2006**

(54) CUTTING GUIDE ARRANGEMENT FOR POWER SAW MACHINE

(76) Inventor: Wy Peron Lee, 11614 Sterling Ave., Suite 103, Riverside, CA (US) 92503

( * ) Notice: Subject to any disclaimer, the term of this patent is extended or adjusted under 35 U.S.C. 154(b) by 0 days.

This patent is subject to a terminal disclaimer.

(21) Appl. No.: 10/227,560

(22) Filed: Aug. 26, 2002

(65) Prior Publication Data

US 2004/0035273 A1 Feb. 26, 2004

(51) Int. Cl.
*B28D 1/04* (2006.01)

(52) U.S. Cl. ..... 125/13.01; 83/435.11; 451/545

(58) Field of Classification Search ..... 125/13.01, 125/35, 13.03; 83/468.7, 435.12, 435.13, 83/435.14, 435.11, 435.15; 451/545, 414; 33/630, 526, 527; 269/10, 319
See application file for complete search history.

(56) References Cited

U.S. PATENT DOCUMENTS

| | | | | | |
|---|---|---|---|---|---|
| 421,546 | A * | 2/1890 | Brown | 269/316 |
| 465,121 | A * | 12/1891 | Welch | 33/526 |
| 500,972 | A * | 7/1893 | Stein | 83/435.15 |
| 702,043 | A * | 6/1902 | Zika | 83/435.14 |
| 1,804,248 | A * | 5/1931 | Crossley | 269/74 |
| 2,894,543 | A * | 7/1959 | Ivy, Jr. | 83/435.14 |
| 2,998,813 | A * | 9/1961 | Wilson | 125/13.03 |
| 3,622,145 | A * | 11/1971 | Gibson | 269/297 |
| 3,830,127 | A * | 8/1974 | James et al. | 83/435.13 |
| 3,986,420 | A * | 10/1976 | Huntley et al. | 83/409.2 |
| 4,206,672 | A * | 6/1980 | Smith | 83/415 |
| 4,219,061 | A * | 8/1980 | Duggins | 144/217 |
| 4,441,394 | A * | 4/1984 | Barsotti | 83/409 |
| 4,464,962 | A * | 8/1984 | Myhre | 83/425 |
| 5,615,665 | A * | 4/1997 | Thiriet | 125/23.02 |
| 5,676,124 | A * | 10/1997 | Lee | 125/13.01 |
| 5,832,913 | A * | 11/1998 | Arends | 125/13.01 |
| 6,000,387 | A * | 12/1999 | Lee | 125/13.01 |
| 6,283,110 | B1 * | 9/2001 | Lee | 125/13.01 |
| 6,508,244 | B1 * | 1/2003 | Lee | 125/12 |
| 2002/0124841 | A1 * | 9/2002 | O'Banion et al. | 125/13.01 |

* cited by examiner

*Primary Examiner*—Kenneth E. Peterson
(74) *Attorney, Agent, or Firm*—Raymond Y. Chan; David & Raymond

(57) ABSTRACT

A cutting guide arrangement cutting guide arrangement, which is incorporated with a power saw machine which includes a cutting platform, having a cutting channel, for supporting a work piece thereon and a cutting blade overhung above the cutting platform for cutting the work piece along the cutting channel, includes a primary guider detachably mounting on the cutting platform in a slidably movable manner. The primary guider includes a guiding arm and a plurality of rip guides provided thereon, wherein each of the rip guides has a guiding edge, which is 45 degrees with respect to the cutting channel, adapted for selectively guiding an edge of the work piece to align a diagonal of the work piece with the cutting channel of the cutting platform.

3 Claims, 12 Drawing Sheets

CUTTING GUIDE ARRANGEMENT FOR POWER SAW MACHINE

BACKGROUND OF THE PRESENT INVENTION

1. Field of Invention

The present invention relates to a saw machine, and more particularly to a power saw machine incorporated with a cutting guide arrangement which comprises a tile guider having a plurality of guider edges capable of guiding tiles to be cut into a desirable size and shape by the power saw machine.

2. Description of Related Arts

Power saw machines are widely used in various industries for provision of rapid and high quality cutting of such construction and manufacturing materials as granite, marble, slate, pave, brick, ceramics, and masonry. A conventional power saw machine usually comprises a supporting frame, a cutting platform securely mounted on the supporting frame, and a cutter head which is movably overhung on top of the cutting platform and comprises a cutting blade which is arranged to be driven by a motor so as to cut a work piece laid and fixed on the cutting platform. In order to cut the work piece into a desirable shape, the work piece is orientated into different directions and slowly moved towards the rotating cutting blade.

Despite the advancement of mechanical and electrical design of the power saw machine in recent years, little has been done on the guiding mechanism of the work piece, leaving the applications of the power saw machine to be rather limited, and that the operation of the it becomes inflexible. Because of these reasons, very often, the 'products' of such conventional power saw machine merely have conventional shapes such as square, rectangular shape, and at best, triangular shape.

Although it is unfair to say that there is no conventional guiding mechanism employed in conventional power saw machine, the existence of which allows only among the simplest shapes of raw material to be cut. Also, when a tile needs being cut diagonally, a user can merely use his or her experiences to adjust the position of the tile on the cutting platform. Even though a right triangular shaped tile guider is incorporated with the power saw machine for guiding the tile on the cutting platform, the tile guider can only guide one side edge of the tile such that the tile may force to be misaligned during cutting. Thus, due to the various sizes of the tile, the user always has difficulty to guide the tile because of the standard size of the tile guider.

SUMMARY OF THE PRESENT INVENTION

A main object of the present invention is to provide a cutting guide arrangement for a power saw machine, wherein the cutting guide arrangement is capable of easily and quickly guiding a working piece on the cutting platform in a desirable alignment.

Another object of the present invention is to provide a cutting guide arrangement for a power saw machine, wherein the cutting guide arrangement comprises a primary guider having a plurality of guiding edges for guiding work pieces of different sizes to be cut into different shapes, so as to enhance flexibility of the cutting guide arrangement as compared with related prior arts.

Another object of the present invention is to provide a cutting guide arrangement for a power saw machine, wherein the cutting guide arrangement further comprises an enhancement guider detachably and movably mounted on the primary guider wherein the enhancement guider is capable of guiding work pieces of different sizes to be cut in a wide range of orientations. Furthermore, the primary guider, when incorporated with the enhancement guider, will act as a supporting base for the enhancement guider so as to maximize the rigidity and stability thereof.

Another object of the present invention is to provide a cutting guide arrangement for a power saw machine, wherein the cutting guide arrangement does not alter the original structural design and operation of the power saw machine, so as to maximize the application range of the cutting guide arrangement, and to minimize the manufacturing and marketing cost thereof.

Accordingly, in order to accomplish the above objects, the present invention provides a cutting guide arrangement for a power saw machine which comprises a cutting platform, having a cutting channel, for supporting a work piece, thereon and a cutting blade overhung above the cutting platform for cutting the work piece along the cutting channel, wherein the cutting guide arrangement comprises:

a primary guider comprising a guiding arm and a plurality of rip guides provided thereon, wherein each of the rip guides has a guiding edge, which is 45 degrees with respect to the cutting channel, adapted for selectively guiding an edge of the work piece to align a diagonal of the work piece with the cutting channel of the cutting platform; and means for detachably mounting the guiding arm of the primary guider on the cutting platform in a slidably movable manner.

DETAILED DESCRIPTION OF THE PREFERRED EMBODIMENT

Figure 1:
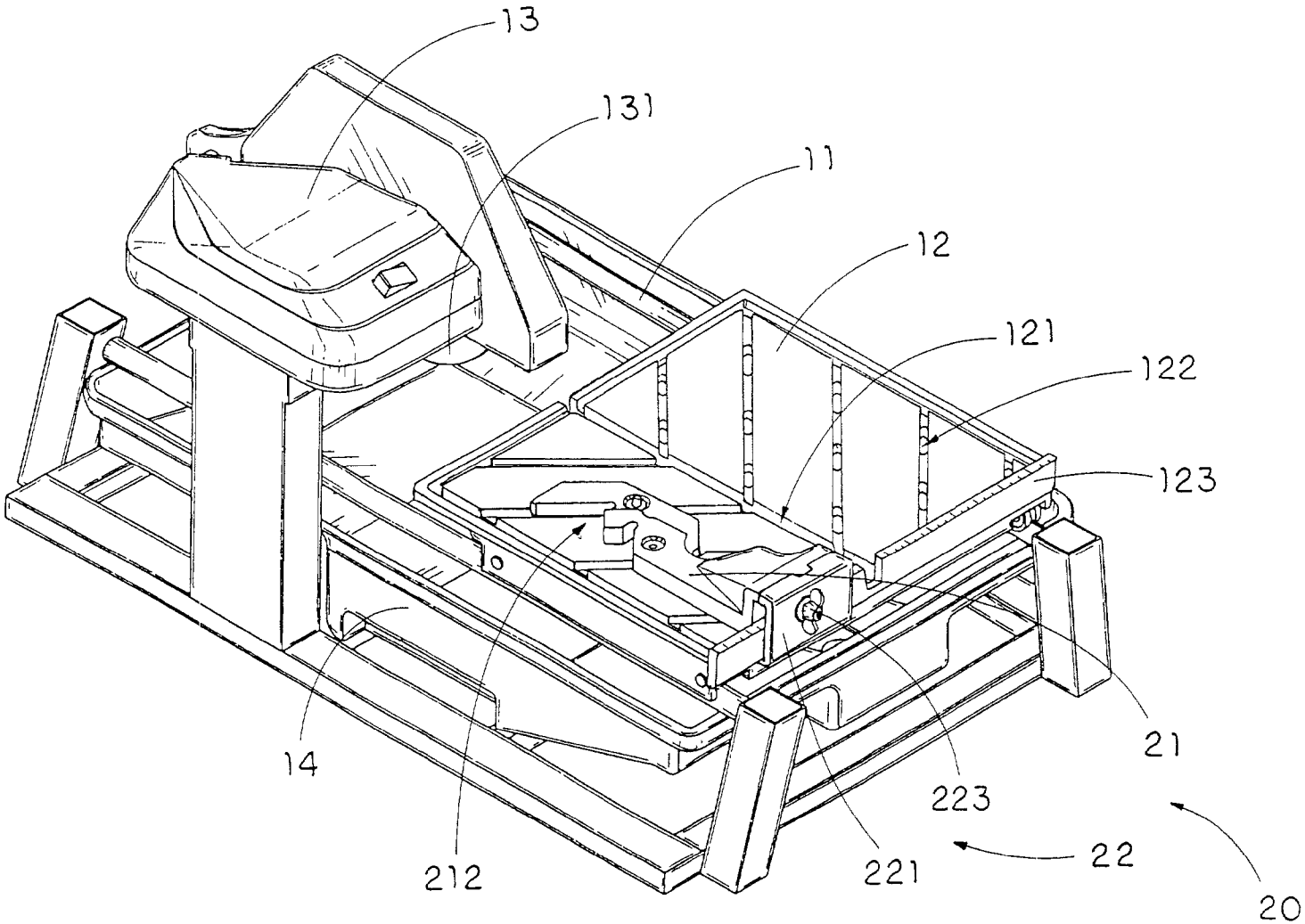
FIG. 1 is a perspective view of a power saw machine incorporated with a cutting guide arrangement according to a first preferred embodiment of the present invention.

Referring to FIG. 1 of the drawings, a power saw machine 1 incorporated with a cutting guide arrangement 20 according to a first preferred embodiment of the present invention is illustrated. According to the first preferred embodiment, the power saw machine 1 is a standard cutting machine and comprises a supporting frame 11, a cutting platform 12, a cutter head 13, and a collecting tank 14.

The cutting platform 12 is slidably mounted on the supporting frame 11 wherein a work piece which is to be cut is arranged to place on the cutting platform 12 for machining. The cutter head 13, which is supported by the supporting frame 11 and overhangs the cutting platform 12, comprises a cutting blade 131 adapted to be driven to rotate by a motor so as to cut the work piece laid on the cutting platform 12. Preferably, the cutting platform 12 has a cutting channel 121 indently formed thereon wherein the cutting blade 13 is supported in the cutting channel 121 so that by moving the work piece at a desirable orientation across the cutting channel 121, preferably guided by the cutting guide arrangement 20 of the present invention, the work piece will be cut by the cutting blade 13 in a predetermined shape. Furthermore, the collecting tank 14 is detachably mounted at a lower portion of the supporting frame 11 and adapted for collecting any coolant liquid used in cutting the work piece and residues produced in the cutting process.

The cutting platform 12 further has a plurality of guiding grooves 122 spacedly formed thereon wherein each of the guiding grooves 122, having at least a through hole formed on a side wall of the guiding groove 122, is extended from the cutting channel 121 to a side edge of the cutting platform 12 for collecting and guiding the coolant liquid used during the cutting process to the collecting tray 14 through the through hole. Each of the guiding grooves 122 is embodied as inclinedly extending from the cutting channel 121 at an angle of substantially 45 degrees.

Figure 2:
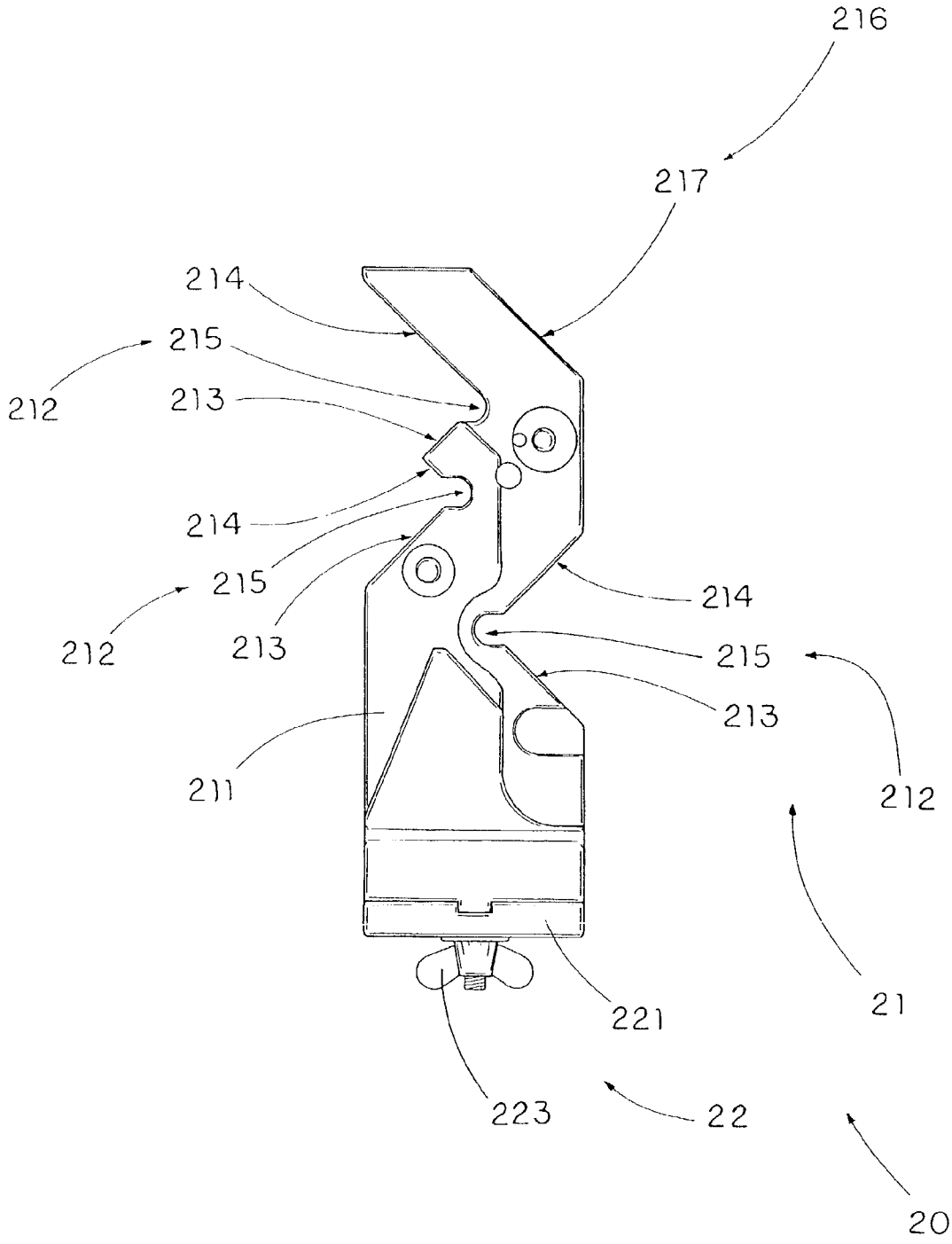
FIG. 2 is a top view of a primary guider according to the above first preferred embodiment of the present invention.

Referring to FIG. 2 of the drawings, the cutting guide arrangement 20 comprises a primary guider 21 which comprises a guiding arm 211 and a plurality of rip guides 212 provided thereon, wherein each of the rip guides 212 has a guiding edge 213, which is 45 degrees with respect to the cutting channel 121, adapted for selectively guiding an edge of the work piece so as to align a diagonal of the work piece with the cutting channel 121 of the cutting platform 12.

Accordingly, by aligning the edge of the work piece with the guiding edge 213, a cutting line of the work piece will overlappedly align with the cutting channel 121 so that by sliding the cutting platform 12 to the cutting bade 131 along the cutting channel 121, the work piece will be cut along the predetermined cutting line.

The cutting guide arrangement 20 further comprises means 22 for slidably mounting the guiding arm 211 of the primary guider 21 on the cutting platform 12. The mounting means 22 comprises a slider body 221 positioned at a rear end of the guiding arm 21 to form a sliding groove 222 between slider body 221 and the guiding arm 21 for detachably receiving a side ruler 123 of the cutting platform 12, and an adjustable connector 223 connected the slider body 221 with the guiding arm 21 to adjust a width of the sliding groove 222 for securely locking the guiding arm 21 on the side ruler 123 in position.

As shown in FIG. 1, the side ruler 123 is mounted along a side edge of the cutting platform 12, wherein the sidetrack 211 preferably has a plurality of unit markings marked thereon for a user of the present invention to measure the dimension of the work piece and to monitor the progress of the cutting process. Thus, by sliding the primary guider 21 along the side ruler 123, the user is able to align different cutting lines of the work piece with the cutting blade 131 so as to cut the work piece into desirable shape and size.

According to the first preferred embodiment, the guiding arm 211 is cut to have a predetermined shaped to form the rip guides 212 wherein the guiding edges 213 of each of the rip guides 212 are spacedly formed as two side edges of the guiding arm 211. In other words, each side edge of the guiding arm 211 is parallelly aligned with respect to the cutting channel 121 wherein each of the guiding edges 213 is inclinedly and inwardly extended from one of the side edges of the guiding arm 211 in such a manner that when the edge of the work piece is guided by the respective guiding edge 213, the cutting line of the work piece is aligned with the cutting channel 121. It is worth mentioning that the cutting line of the work piece can be a diagonal of the work piece or the non-diagonal of the work piece predetermined by the user.

As shown in FIG. 2, there are three rip guides 212 provided on the guiding arm 211, wherein each of the rip guides 212 has a predetermined size to guide the work piece is different size. For example, the rip guides 212 are shaped to fit a 8-inch, 12-inch, and a 14 inch work pieces respectively so that the primary guider 20 is capable of guiding different sizes of the work piece on the cutting platform 12 for cutting purpose, as shown in FIGS. 3A through 3D.

As mentioned above, each of the rip guides 212 further has a biasing edge 214 extended from the respective side edge of the guiding arm 211 at a position perpendicular to the guiding edge 213 for biasing against an adjacent edge of the work piece so as to precisely guide the cutting line to align with the cutting channel 121 of the cutting platform 12. Moreover, each rip guide 212 has an alignment hole 215 formed at an intersection of the guiding edge 213 and the biasing edge 214 in such a manner when the two adjacent edges of the work piece are guided by the guiding edge 213 and the biasing edge 214 respectively, a corner at the two adjacent edges of the work piece is positioned within the alignment hole 215 so that the two adjacent edges of the work piece will be fittedly engaged with the rip guide 212 concerned. Then, by slidably moving the primary guider 21 along the cutting platform 12, the cutting line of the work piece will be aligned with the cutting blade 131.

Up to this point, it is worth mentioning that the angle between the guiding edge 213 and the biasing edge 214 is subjected to change in order to further enhance the flexibility of the cutting guide arrangement 2 of the present invention. Thus, the guiding arm 211 can be crafted to have the rip guide 203 having the guiding edge 213 say, 45 degrees with respect to the cutting channel 121.

Equally remarkable is that the roundness of the corner formed by the guiding edge 213 and the biasing edge 214 for a particular rip guide 212 of the guiding arm 211 can also be varied so as to enhance the flexibility of the cutting guide arrangement 2 of the s present invention. Generally speaking, it is a good practice from engineering's point of view that the sharp corners of the work piece should be filleted in order to reduce the potential harmful effect from the work piece to surrounding people.

Figure 3A:
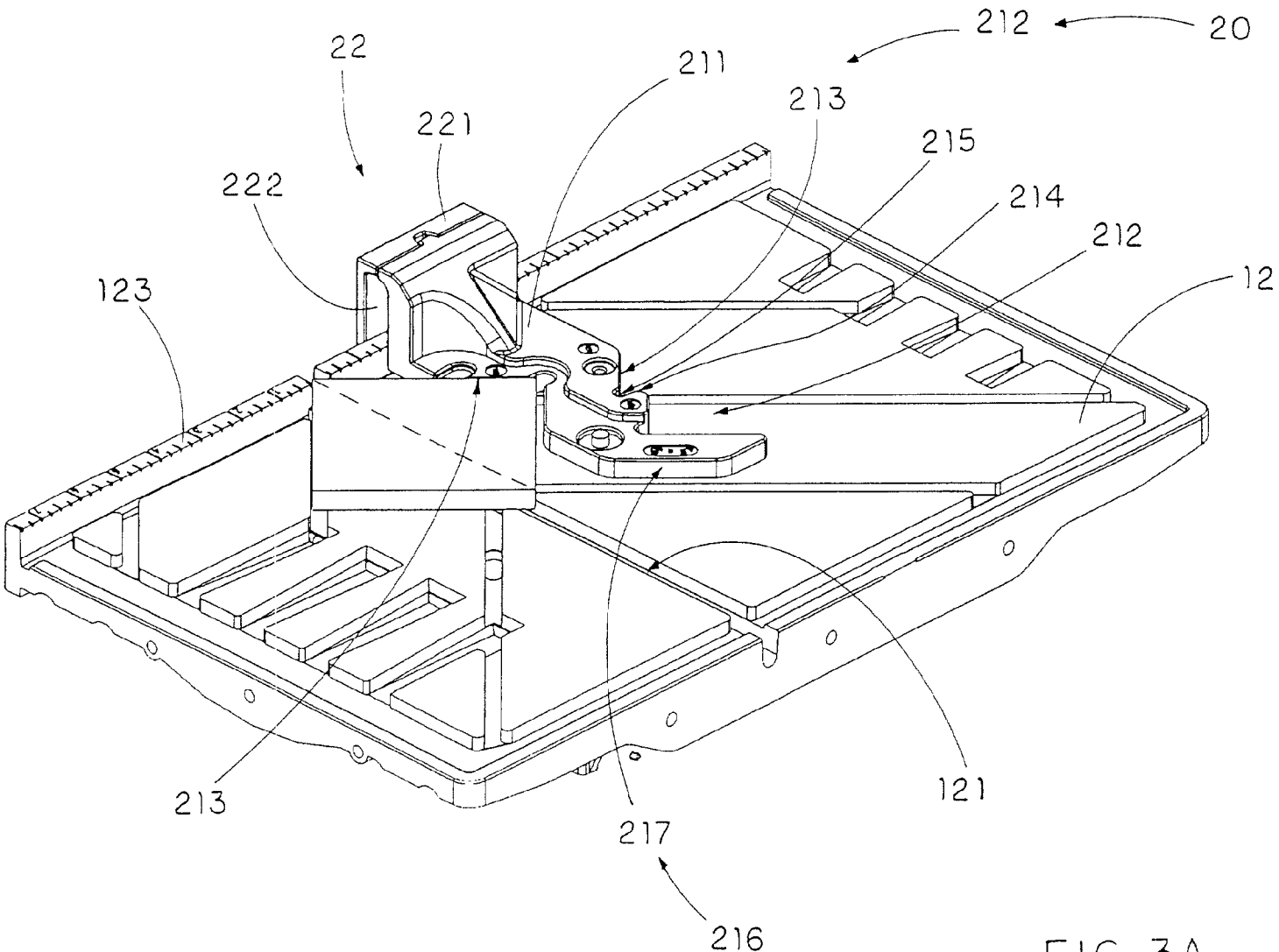
FIGS. 3A through 3E illustrate the primary guider for guiding different sizes of work pieces according to the above first preferred embodiment of the present invention.
Figure 3B:
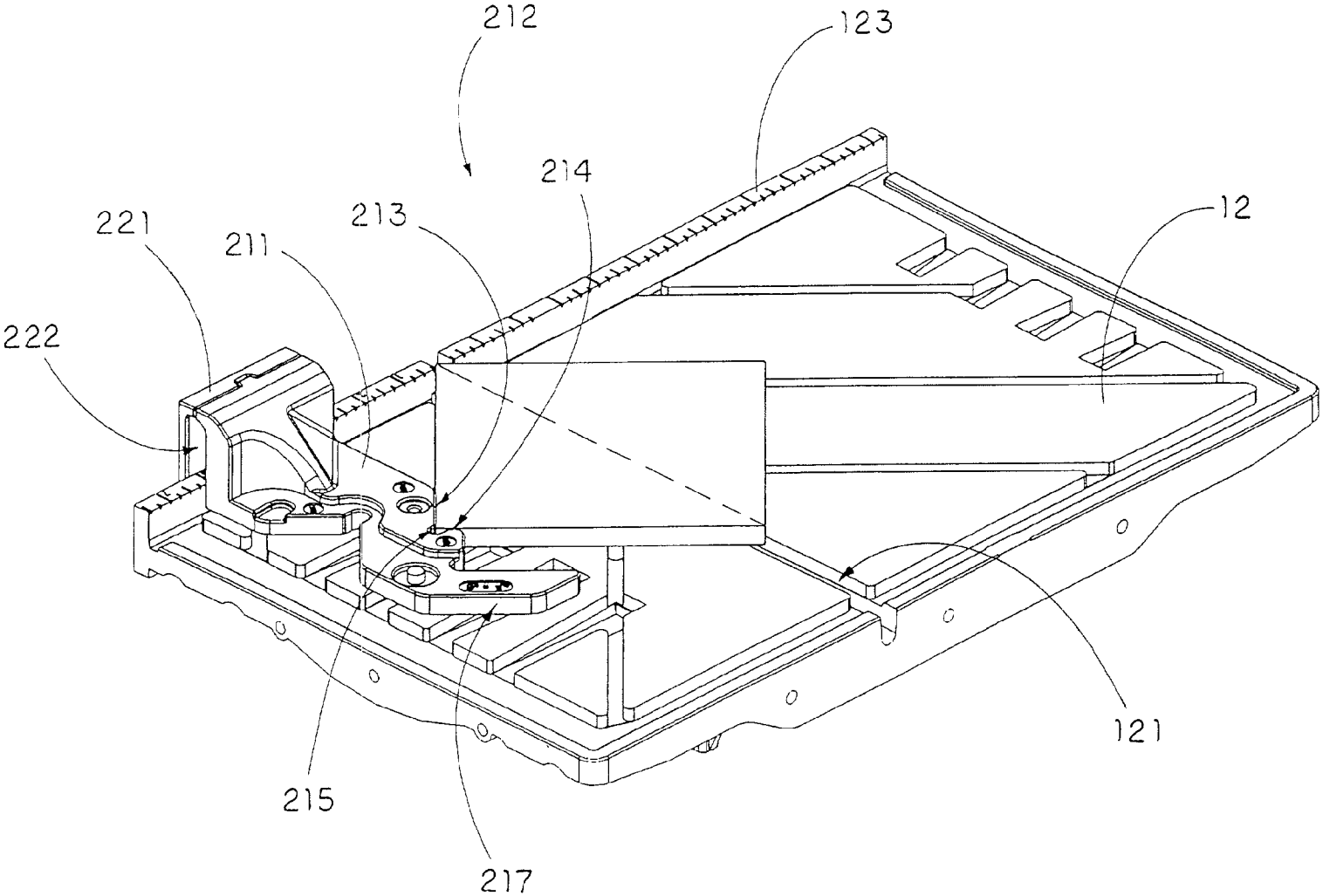
Figure 3C:
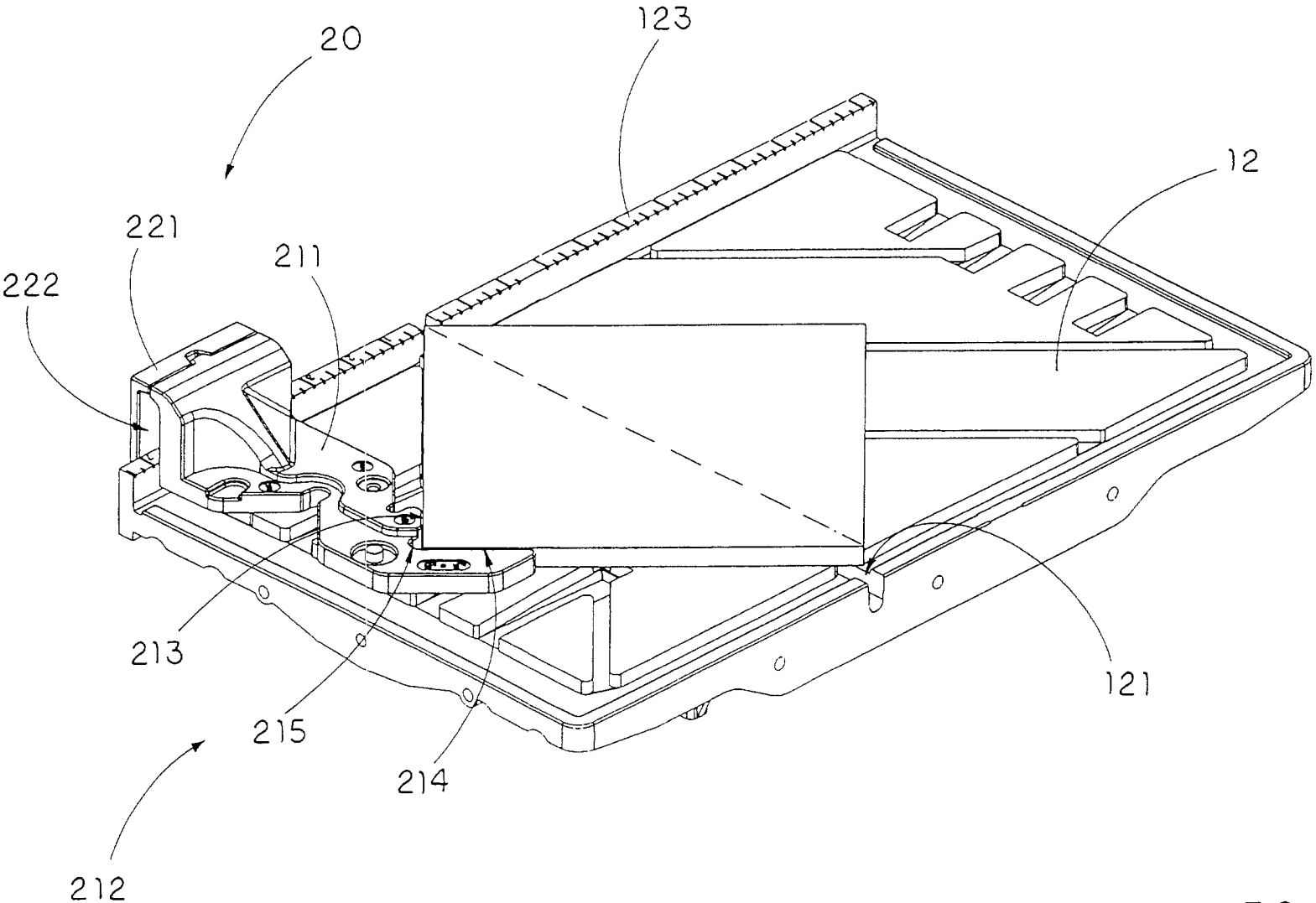
Figure 3D:
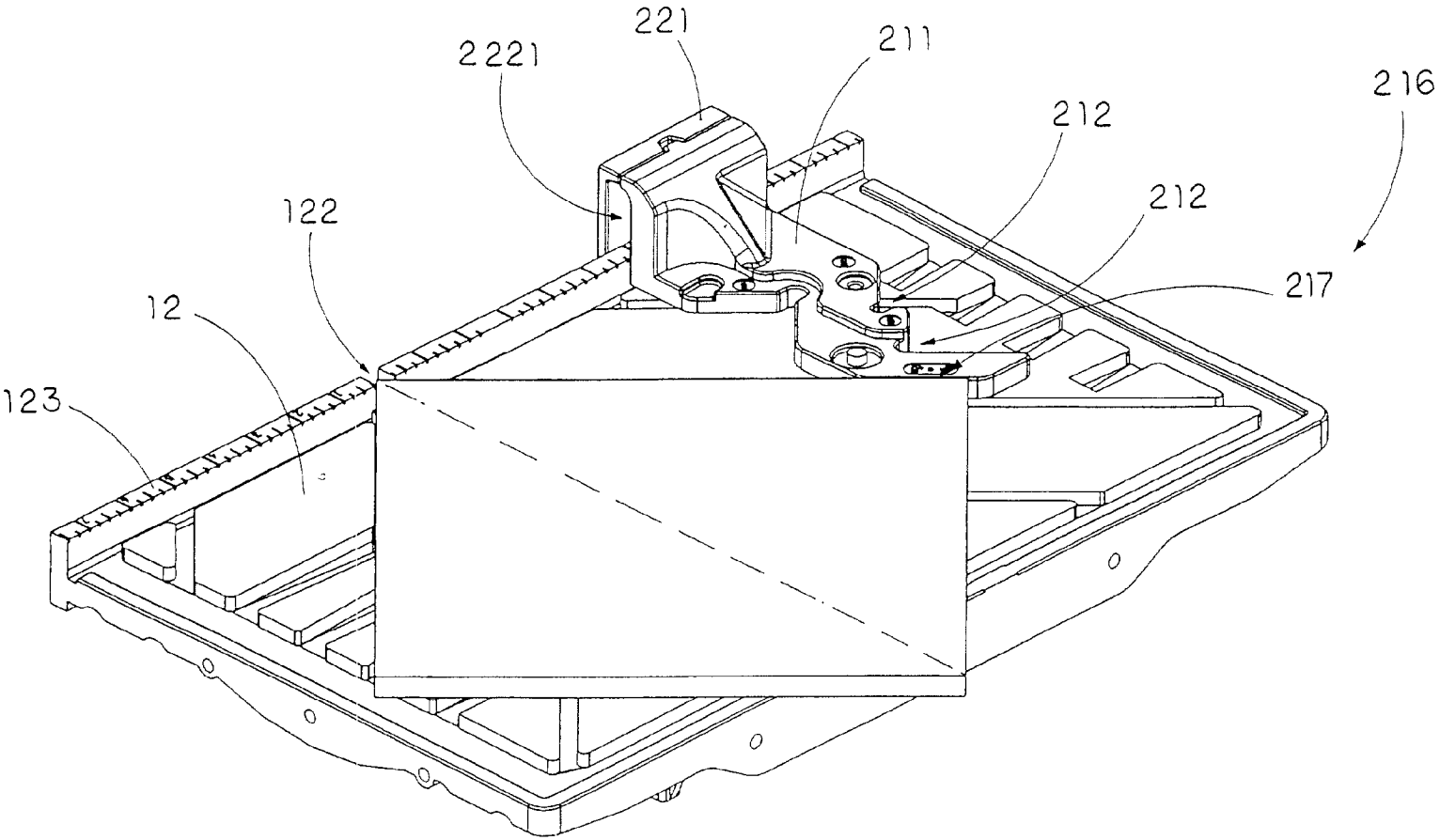
Figure 3E:
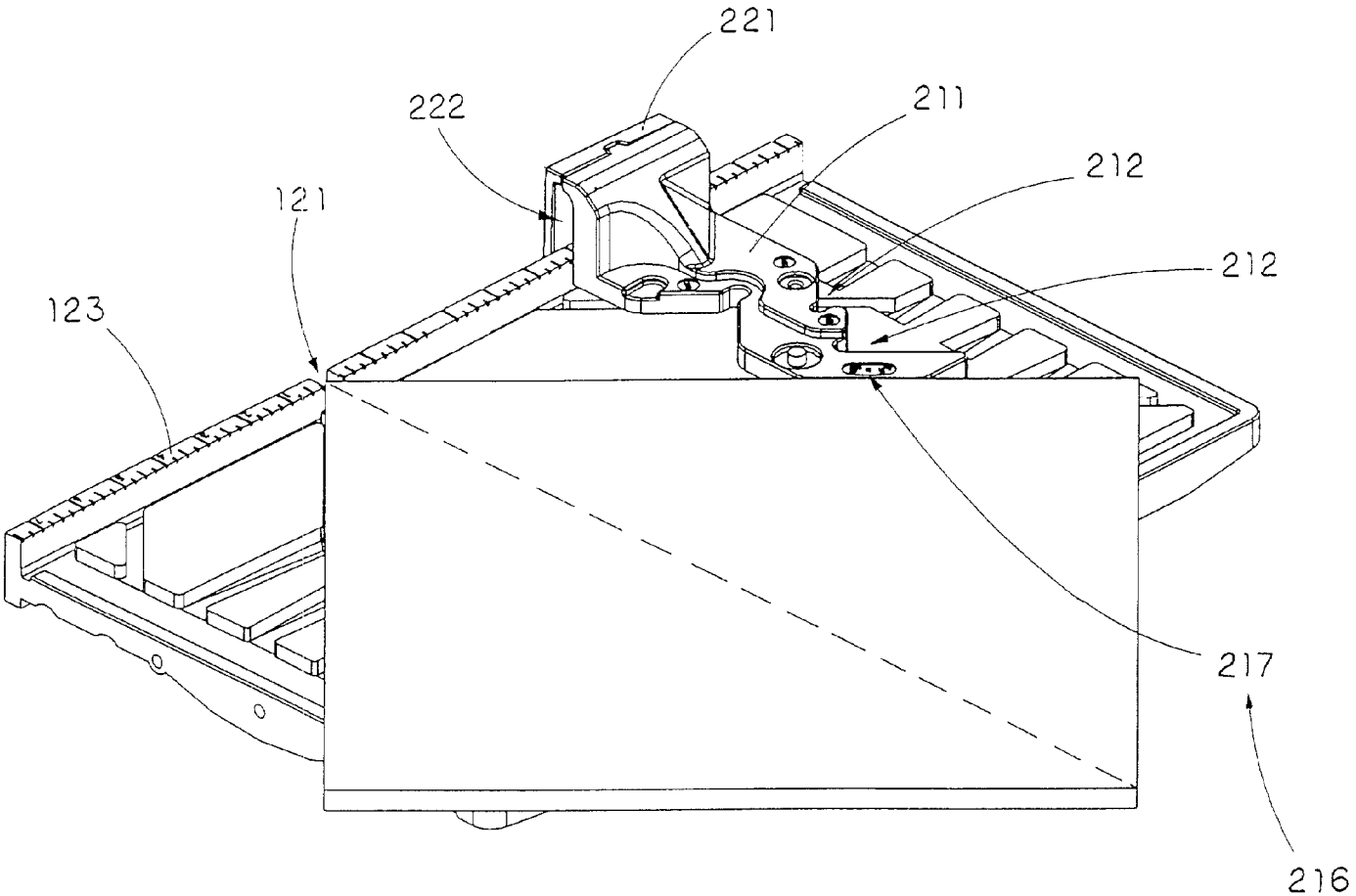

As shown in FIG. 2, the primary guider 21 further comprises an auxiliary rip guide 216 formed at an outer end portion of the guiding arm 211 wherein the auxiliary rip guide 216 has an auxiliary guiding edge 217, which is 45 degrees with respect to the cutting channel 121, adapted for guiding the work piece having a size larger than 14 inches. The auxiliary guiding edge 217 is inclinedly and inwardly extended from one of the side edge of the guiding arm 211 to an outer edge thereof in such a manner that the auxiliary guiding edge 217 of the auxiliary rip guide 216 is capable of guiding the edge of the work piece having the size larger than 14 inches, as shown in FIG. 3E.

In order to utilize the cutting guide arrangement 2 of the present invention, one has first to identify the cutting line of the work piece; then place the work piece at one of the suitable rip guides 212 of the primary guider 20 while the edge of the work piece is biased against the guiding edge 213; third, slidably move the primary guider 20 until the cutting line aligns with the cutting channel 121; and finally, slidably move the cutting platform 12 to toward the cutting blade 131 to cut the work piece along the cutting line so as to cut the work piece into a desirable shape.

Figure 4:
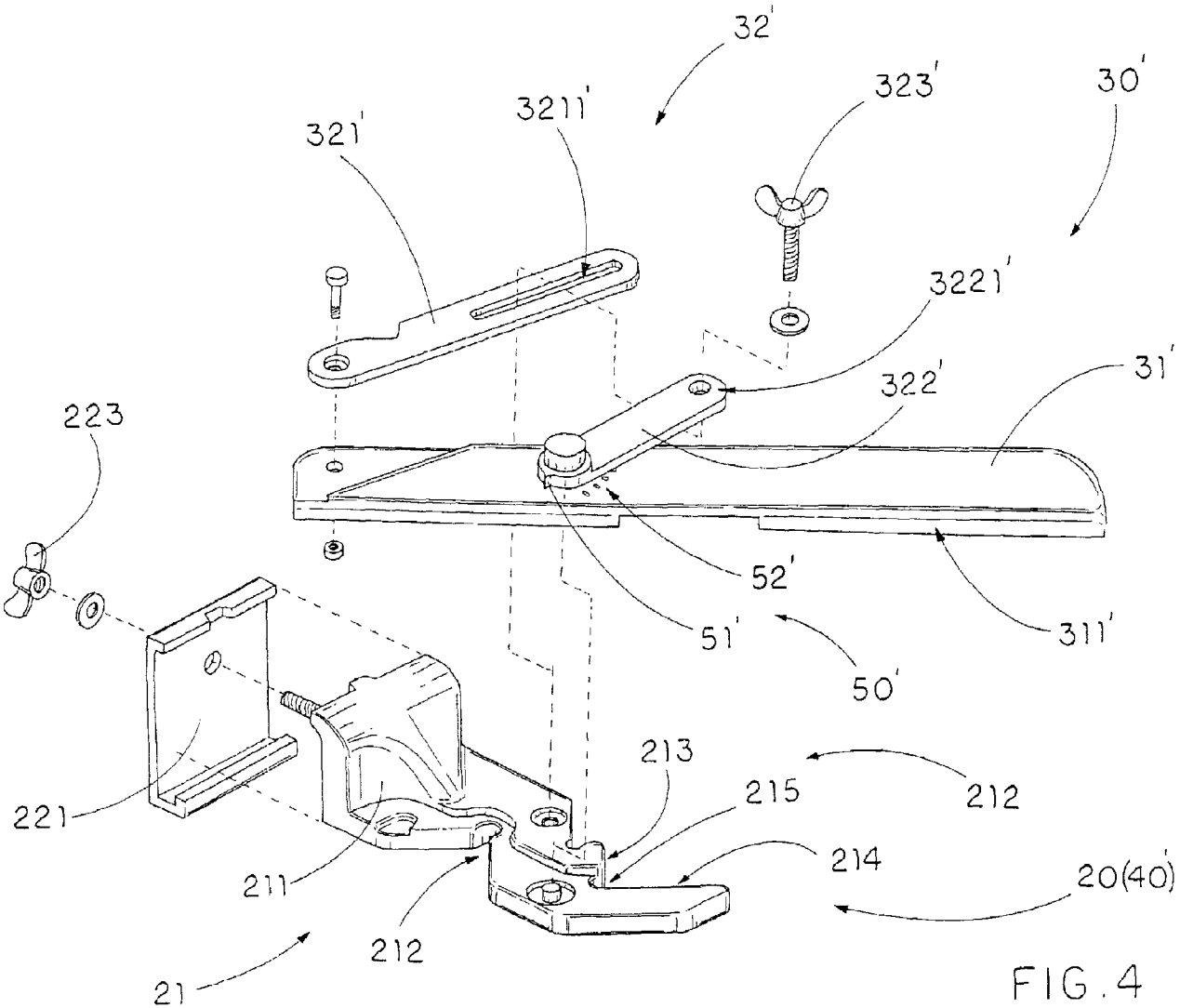
FIG. 4 is an exploded perspective view of the cutting guide arrangement according to a second preferred embodiment of the present invention.

Referring to FIG. 4 of the drawings, the cutting guide arrangement 2' according to a second preferred embodiment of the present invention is illustrated. According to the second preferred embodiment, the cutting guide arrangement 2' comprises a supporting platform 40' and an enhancement guider 30', wherein the primary guider 20 of the above first preferred embodiment forms the supporting platform 40' according to second preferred embodiment. In other words, the primary guider 20 acts as the supporting platform 40' wherein the enhancement guider 30' movably and detachably mounted on the supporting platform 40' for guiding the work piece.

The enhancement guider 30' comprises a principle guider 31' which is rotatably mounted on the supporting platform 40' and has an elongated principle guiding edge 311' for guiding an edge of the work piece, and means 32' for selectively adjusting the principle guider 31' on the supporting platform 40' to align the principle guiding edge 311' with respect to the cutting channel 121' at a predetermined angle. Therefore, when the work piece is placed on the cutting platform 12', the principle guider 31' is adapted for guiding the work piece to be cut in a non-diagonal manner.

The adjusting means 32' comprises a slider arm 321' having one end rotatably connected with an end portion of the principle guider 31' and an elongated sliding groove 3211' formed on another end of the pivot arm 321', a retaining arm 322' having one end rotatably connected with the principle guider 31' and an opposed control end 3221' extended towards the sliding groove 3211' of the slider arm 321', and a control element 323' which is rotatably connected the retaining arm 322' on the supporting platform 40' and slidably connected the control end 3221' of the retaining arm 322' with the slider arm 321' along the sliding groove 3211'. In other words, the principle guider 31, the slider arm 321', and the retaining arm 322' are formed as a pivotally movable triangular structure for guiding the work piece on the cutting platform 12' to selectively adjust the principle guiding edge 311' at a predetermined angle with respect to the cutting channel 121', so as to cut the work piece in a non-diagonal manner.

The principle guiding edge 311' of the principle guider 31' has a predetermined length that capable of substantially increasing a guiding surface between the principle guider 31' and the edge of the work piece, so that the work piece can be precisely cut non-diagonally.

Note that according to the second preferred embodiment, the principle guider 31' is capable of moving on the cutting platform 12' at any position, so that the principle guiding edge 311' of the principle guider 31' can be selectively adjusted the angle with respect to the cutting channel 121'. In other words, the user can flexibly move the principle guider 31' in order to align with a desirable orientation of the cutting line of the work piece.

The control element 323' is a hand screw adapted to lock up the slider arm 321' with respect to the retaining arm 322' so as to prevent an unwanted lateral movement of the principle guider 31'. Accordingly, by loosing the control element 323', the control end 3221' of the retaining arm 322' is capable of slidably moving along the sliding groove 3211' of the slider arm 321' so as to selectively adjust the angle of the principle guiding edge 311' of the principle guider 31' with respect to the cutting channel 121'. Then, by tightening the control element 323', the angle of the principle guiding edge 311' of the principle guider 31' is set to guide the work piece to be cut on the cutting platform 12'.

In addition, the cutting guide arrangement 2' further comprises means 50' for indicating the angle of the principle guiding edge 311' of the principle guider 31' with respect to the cutting channel 121'. The indicating means 50' comprises an indicating pointer 51' provided at the end of the retaining arm 322' and a plurality of indicating markers 52' on the principle guider 31' wherein when the principle guider 31' is rotatably moved with respect to the retaining arm 322', the indicating pointer 52' is driven to point at one of the indicating markers 52', so as to indicate the angle of the principle guiding edge 311' of the principle guider 31' with respect to the cutting channel 121'.

Figure 5A:
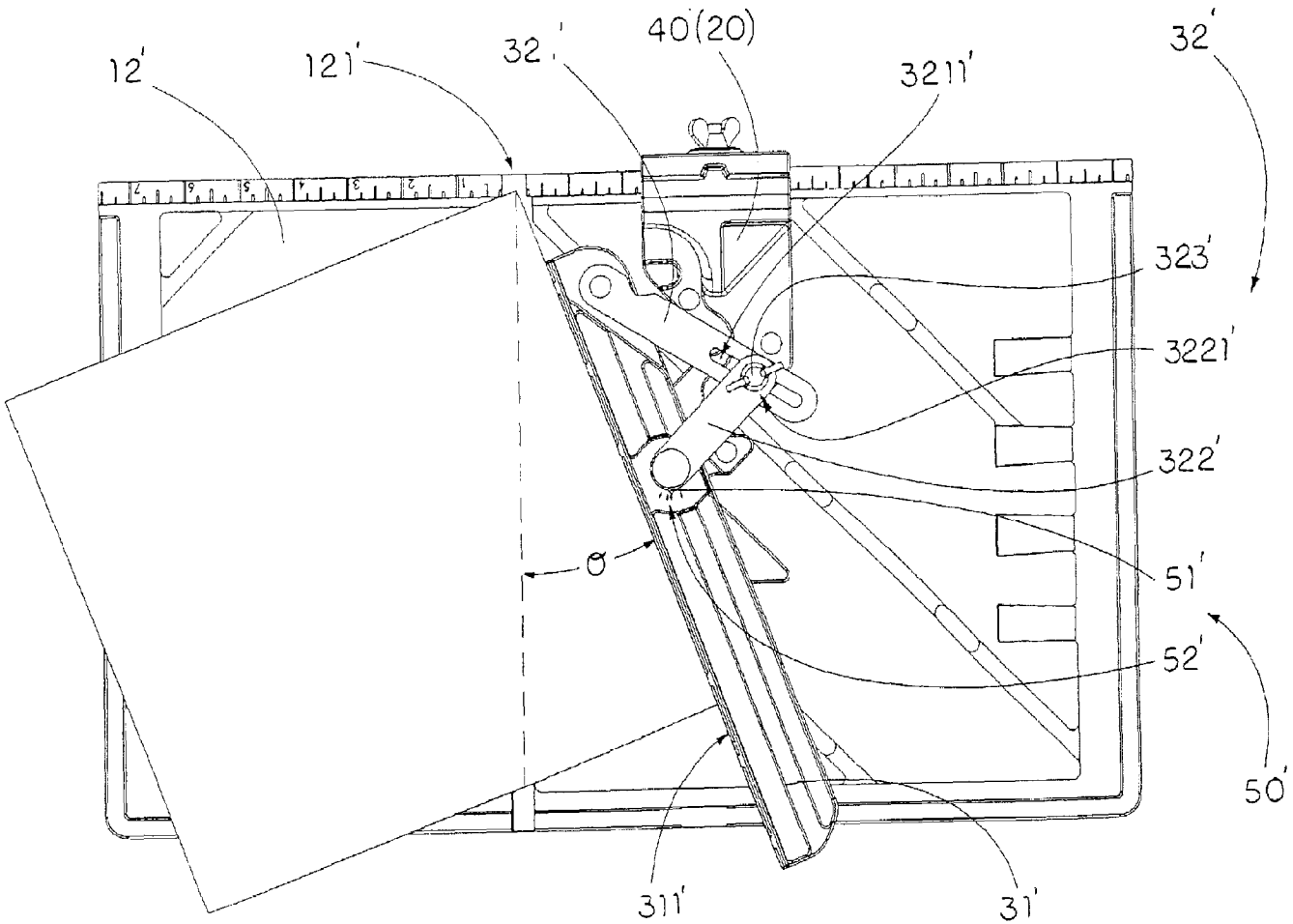
FIGS. 5A through 5D are top views of the cutting guide arrangement according to the above second preferred embodiment of the present invention, illustrating the operation of the cutting guide arrangement.
Figure 5B:
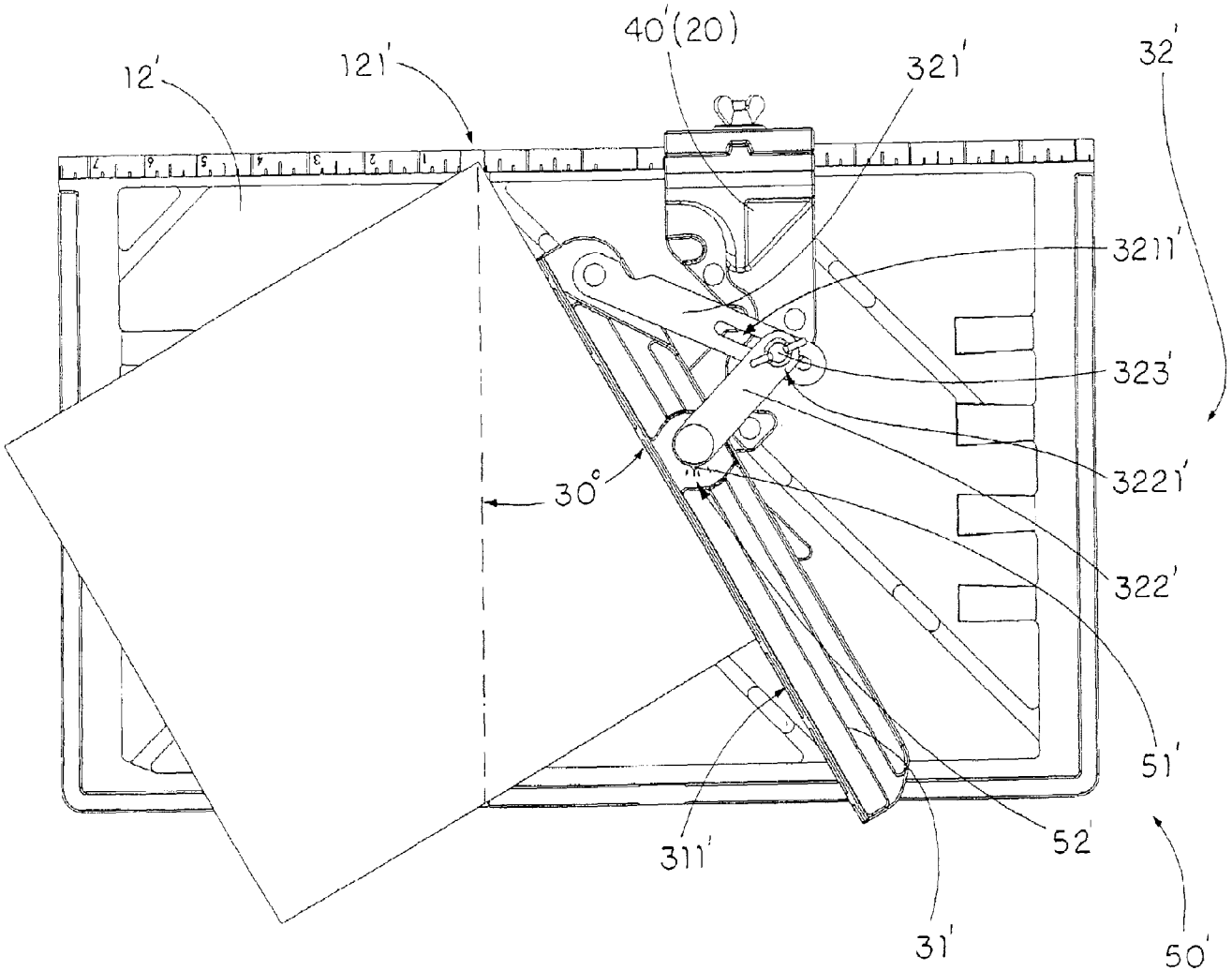
Figure 5C:
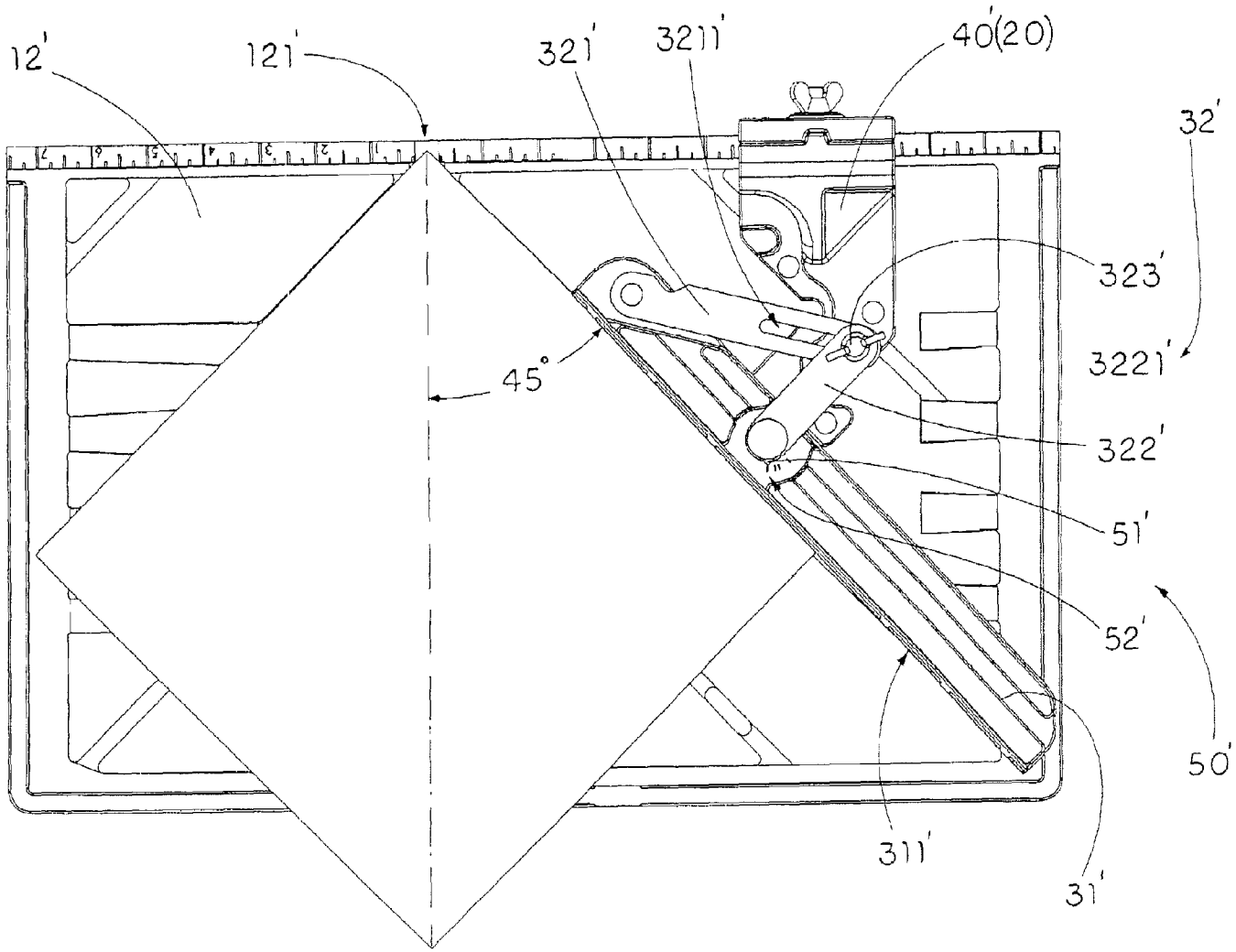
Figure 5D:
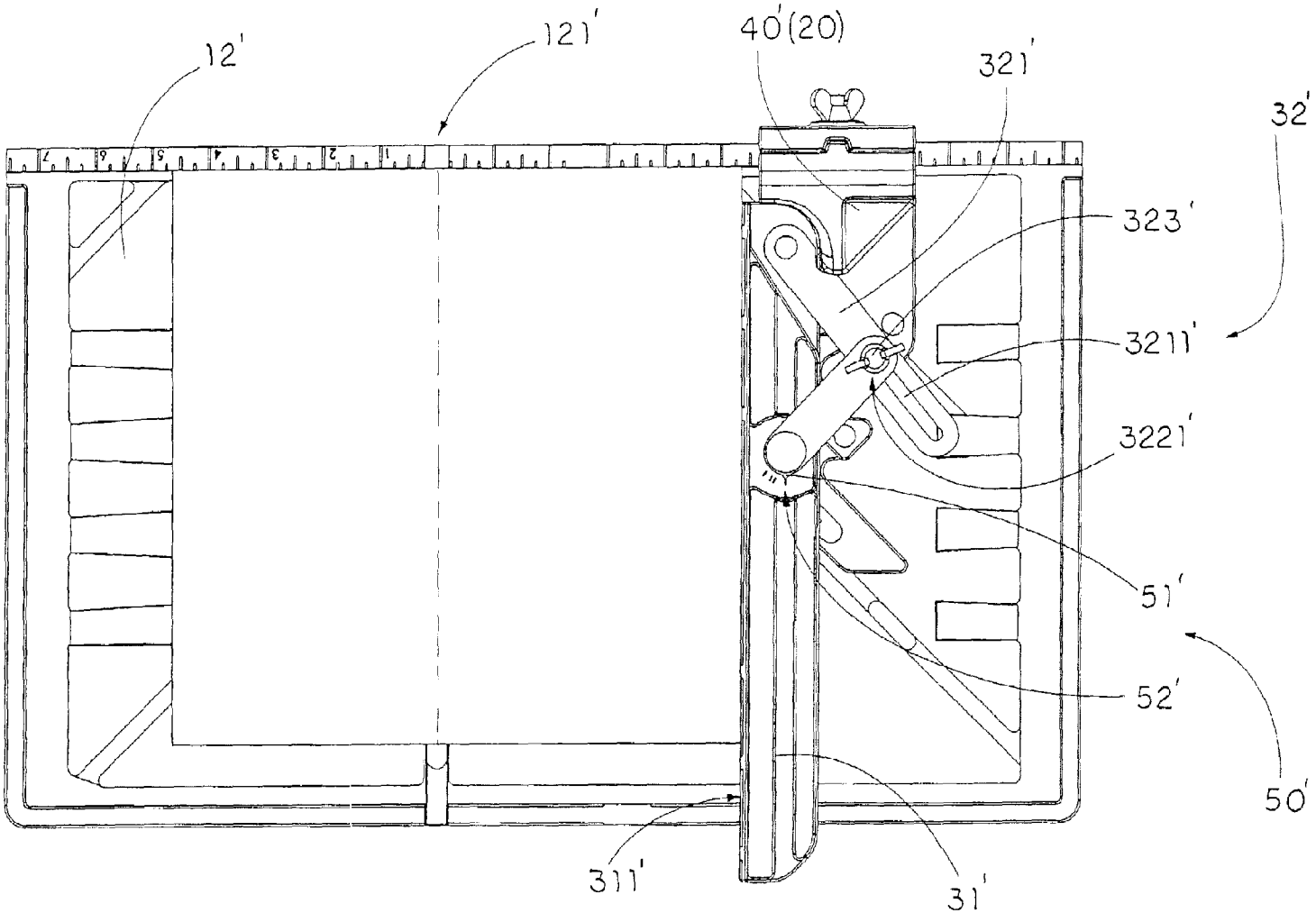

Accordingly, the indicating markers 52' are indicated the angles of 30 degrees, 45 degrees, and 0 degree between the principle guiding edge 311' of the principle guider 31' and the cutting channel 121'. Moreover, the user is able to selectively adjust a desirable angle θ, such as 20 degrees, of the principle guider 31' with respect to the cutting channel 121', as shown in FIG. 5A. It is worth mentioning that the 0-degree indicating marker 52 shows that the principle guiding edge 311' of the principle guider 31' is parallel to the cutting channel 121', as shown in FIG. 5D. Therefore, by selectively adjusting the position of the principle guider 31', the user is able to cut the work piece at any shape as shown in FIGS. 5A to 5D.

As shown in FIGS. 5A to 5D, the user is able to adjust the principle guider 31' by sliding the control end 3221' of the retaining arm 322' along the sliding groove 3211' of the slider arm 321' so as to adjust the angle of the principle guiding edge 311' with respect to the cutting channel 121' in such a manner that the edge of the work piece is biased against the principle guiding edge 311' to align the cutting line of the work piece with the cutting channel 121'. Therefore, when the control element 323' is securely locked up the slider arm 321' with respect to the retaining arm 322', the work piece can be guided by the principle and precisely cut in a non-diagonal manner.

Thus, one skilled in the art would appreciate that the cutting guide arrangement 2' is of great flexibility. It suits a variety of work piece's size and that the cutting orientation of the work piece can be easily adjusted as desired by pivotally moving the principle guider 31' via the adjusting means 32'.

Note also that the primary guider 20 can by itself acts as a guider to guide the work piece, or as in the second preferred embodiment, it can be a supporting agent to support the enhancement guider 30' wherein the principle guider 31' is detachably mounted on the primary guider 20 (supporting platform 40').

Thus, by combining the primary guider 20 (supporting platform 40') and the principle guider 31', a more flexible mechanism for guiding a work piece can be expected the cutting guide arrangement 2' of the present invention can adapt to a wide variety of shapes.

What is claimed is:

1. A power saw machine, comprising:

a cutting platform, having a cutting channel, for supporting a work piece thereon;

a cutting blade overhung above said cutting platform; and a cutting guide arrangement which comprises:

a primary guider comprising an elongated guiding arm having two side edges and a plurality of rip guides spacedly provided at said two side edges of said guiding arm respectively, wherein said rip guides are shaped in different sizes for fitting different sizes of said work pieces thereto, wherein each of said rip guides has a guiding edge, which is 45 degrees with respect to said cutting channel, adapted for selectively guiding an edge of said work piece to align a diagonal of said work piece with said cutting channel of said cutting platform, wherein each of said rip guides further has a biasing edge extended from a said respective side edge of said guiding arm at a position perpendicular to said guiding edge for biasing against an adjacent edge of said work piece so as to precisely guide said diagonal of said work piece in alignment with said cutting channel of said cutting platform; and means for detachably mounting said guiding arm of said primary guider on said cutting platform in a slidably movable manner.

2. The power saw machine, as recited in claim 1, wherein each of said rip guides further has an alignment hole formed at an intersection of said guiding edge and said biasing edge for securely receiving a corner of said work piece when said guiding edge and said biasing edge align with said two adjacent edges of said work piece respectively.

3. The power saw machine, as recited in claim 2, wherein said primary guider further comprises an auxiliary rip guide having an auxiliary guiding edge, which is 45 degrees with respect to said cutting channel, adapted for guiding said work piece having a size larger than 14 inches, wherein said auxiliary guiding edge is inclinedly and inwardly extended from one of said side edges of said guiding arm to an outer edge thereof.

* * * * *